US009859640B1

(12) United States Patent
Horning et al.

(10) Patent No.: US 9,859,640 B1
(45) Date of Patent: Jan. 2, 2018

(54) ELECTRICAL CONNECTOR WITH PLATED SIGNAL CONTACTS

(71) Applicant: TYCO ELECTRONICS CORPORATION, Berwyn, PA (US)

(72) Inventors: Michael James Horning, Lancaster, PA (US); Arturo Pachon Munoz, Hummelstown, PA (US); John Joseph Consoli, Harrisburg, PA (US); Timothy Robert Minnick, Enola, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/350,710

(22) Filed: Nov. 14, 2016

(51) Int. Cl.
*H01R 13/03* (2006.01)
*H01R 13/514* (2006.01)
*H01R 13/658* (2011.01)

(52) U.S. Cl.
CPC ..... *H01R 13/03* (2013.01); *H01R 13/514* (2013.01); *H01R 13/658* (2013.01)

(58) Field of Classification Search
CPC ..... H01R 13/03; H01R 13/514; H01R 13/658
USPC ..... 439/607.23
See application file for complete search history.

(56) References Cited

U.S. PATENT DOCUMENTS 4,655,519 A * 4/1987 Evans ..... H05K 7/1069 439/514
5,066,550 A * 11/1991 Horibe ..... H01H 11/041 200/266
2010/0144169 A1* 6/2010 Glover ..... H01R 12/585 439/68
2013/0115821 A1* 5/2013 Golko ..... H01R 13/516 439/638
2014/0045352 A1* 2/2014 Weber ..... H01R 13/03 439/78
2016/0064846 A1* 3/2016 Tadokoro ..... H01R 13/03 439/886
2016/0247592 A1* 8/2016 Sawada ..... C25D 5/12
2016/0372276 A1* 12/2016 Han ..... H01H 11/04

* cited by examiner

*Primary Examiner* — Alexander Gilman

(57) ABSTRACT

An electrical connector is provided that includes a housing and ground contacts held by the housing for mating with corresponding ground contacts of a complementary mating connector. The ground contacts are plated with a ground contact plating that includes at least one ground contact plating material. Signal contacts are held by the housing for mating with corresponding signal contacts of the mating connector. The signal contacts are plated with a signal contact plating that includes at least one material that is different from the at least one ground contact plating material.

20 Claims, 5 Drawing Sheets

ELECTRICAL CONNECTOR WITH PLATED SIGNAL CONTACTS

BACKGROUND OF THE INVENTION

The subject matter herein relates generally to electrical connectors having plated signal contacts.

The electrical contacts of many known electrical connectors are often plated to improve the electrical performance and mechanical reliability of the connector. For example, the base materials of the signal and ground contacts of higher-speed connectors are often plated with one or more other materials (e.g., precious metals, alloys thereof, and/or the like) that provide the contacts with a lower contact resistance. Moreover, the base material of the electrical contacts of some connectors is plated with one or more materials (e.g., nickel (Ni), alloys thereof, and/or the like) that increase the durability of the contacts to reduce the wear generated from repeated mating and de-mating of the electrical connector. But, plating the signal and ground contacts of an electrical connector can be expensive and thereby increase the cost of manufacturing the connector, particularly when the plating includes a precious metal.

There is a need to reduce plating cost for contacts of an electrical connector without sacrificing electrical performance of the electrical connector.

BRIEF DESCRIPTION OF THE INVENTION

In an embodiment, an electrical connector includes a housing and ground contacts held by the housing for mating with corresponding ground contacts of a complementary mating connector. The ground contacts are plated with a ground contact plating that includes at least one ground contact plating material. Signal contacts are held by the housing for mating with corresponding signal contacts of the mating connector. The signal contacts are plated with a signal contact plating that includes at least one material that is different from the at least one ground contact plating material.

In an embodiment, an electrical connector includes a housing and ground contacts held by the housing for mating with corresponding ground contacts of a complementary mating connector. Signal contacts are held by the housing for mating with corresponding signal contacts of the mating connector. The signal contacts are plated with a greater number of layers of plating as compared to the ground contacts.

DETAILED DESCRIPTION OF THE INVENTION

Figure 1:
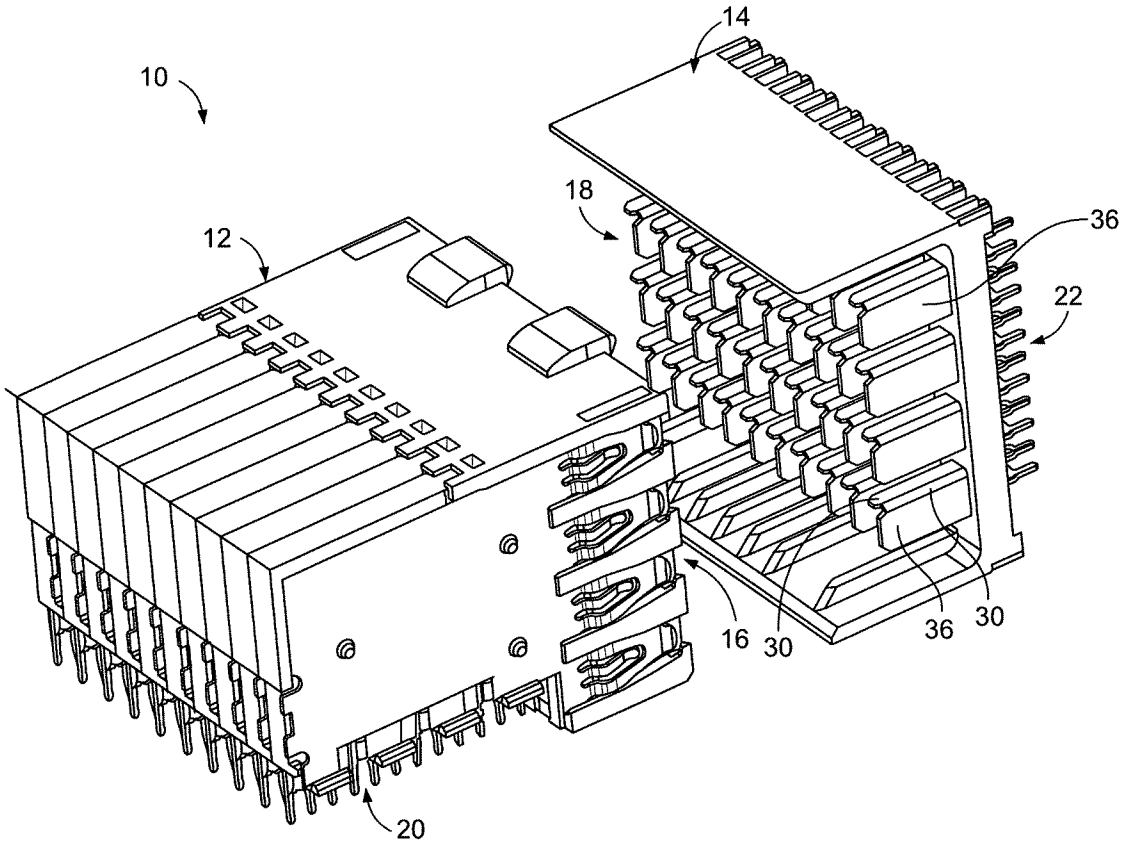
FIG. 1 is a perspective view of an embodiment of an electrical connector system.

FIG. 1 is a perspective view of an embodiment of an electrical connector system 10. The system 10 includes a receptacle connector 12 and a header connector 14 that are configured to mate together to establish an electrical connection between two circuit boards (not shown). The receptacle connector 12 and the header connector 14 include respective mating interfaces 16 and 18 at which the connectors 12 and 14 are configured to be mated together. The receptacle connector 12 and the header connector 14 may each be referred to herein as an "electrical connector".

The receptacle connector 12 is configured to be mounted to one of the circuit boards along a mounting interface 20 of the receptacle connector 12. Similarly, the header connector 14 is configured to be mounted to the other circuit board along a mounting interface 22 of the header connector 14. In the illustrated embodiment, the mounting interface 20 of the receptacle connector 12 is oriented approximately perpendicular to the mating interface 16 of the receptacle connector 12; and the mounting interface 22 of the header connector 14 is oriented approximately parallel to the mating interface 18 of the header connector 14. Accordingly, when the receptacle connector 12 is mated with the header connector 12, the circuit boards are orientated approximately perpendicular to each other, however, other orientations are possible in other embodiments.

Figure 2:
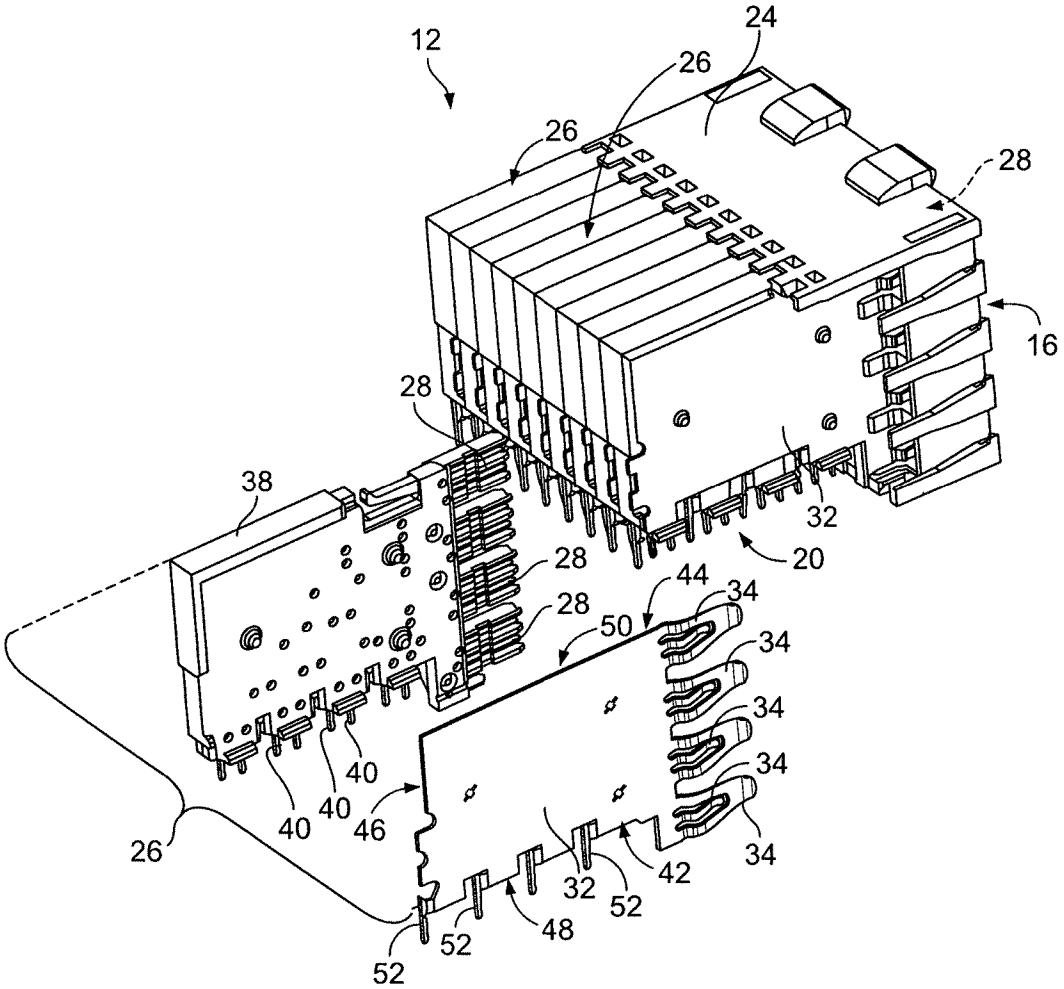
FIG. 2 is a partially exploded perspective view of an embodiment of a receptacle connector of the electrical connector system shown in FIG. 1.

FIG. 2 is a partially exploded perspective view of an embodiment of the receptacle connector 12. The receptacle connector 12 includes a housing 24 that holds a plurality of contact modules 26. The contact modules 26 are held in a stacked configuration generally parallel to one another. The contact modules 26 hold a plurality of signal contacts 28 that extend along the mating interface 16 for mating with corresponding mating signal contacts 30 (shown in FIGS. 1, 3, 5, and 6) of the header connector 14 (shown in FIGS. 1, 3, 4, and 5). Optionally, the signal contacts 28 are arranged in pairs carrying differential signals, as is shown in the illustrated embodiment. In the illustrated embodiment, the contact modules 26 are oriented generally along vertical planes. But, other orientations are possible in other embodiments. For example, in some embodiments, the contact modules 26 are oriented generally along horizontal planes.

The housing 24 is manufactured from a dielectric material, such as, but not limited to, a plastic material and/or the like. The housing 24 includes a plurality of signal contact openings (not shown) and a plurality of ground contact openings (not shown) extending along the mating interface 16. The contact modules 26 are mounted to the housing 24 such that the signal contacts 28 are received in corresponding signal contact openings. When received within the corresponding signal contact openings, the signal contacts 28 define a portion of the mating interface 16 of the receptacle connector 12. Optionally, a single signal contact 28 is received in each signal contact opening. The signal contact openings also receive corresponding mating signal contacts of the header connector 14 when the receptacle connector 12 is mated with the header connector 14.

The signal contact openings, and thus the signal contacts 28, may be arranged in any pattern. In the illustrated embodiment, the signal contact openings are arranged in an array of rows and columns. The columns are oriented generally vertically and the rows are oriented generally horizontally; however, other orientations are possible in other embodiments. In the illustrated embodiment, the signal contacts 28 within each differential pair are arranged in a same column, and thus the receptacle connector 12 defines a pair-in-column receptacle connector. In other embodiments, the signal contacts 28 within each differential pair are arranged in the same row such that the receptacle connector 12 defines a pair-in-row receptacle connector.

Each contact module 26 includes a dielectric carrier 38 that holds an array of conductors. The carrier 38 may be overmolded over the array of conductors, though additionally or alternatively other manufacturing processes may be utilized to form the carrier 38. Optionally, the array of conductors is stamped and formed as an integral leadframe prior to overmolding of the carrier 38. Portions of the leadframe that connect the conductors are removed after the overmolding to provide individual conductors in the array held by the carrier 38. In addition or alternatively, other manufacturing processes are used to form the conductor array.

The conductor array includes the signal contacts 28, a plurality of mounting contacts 40, and leads (not shown) that connect the signal contacts 28 to the corresponding mounting contacts 40. The signal contacts 28, the leads, and the mounting contacts 40 define signal paths through the contact module 26. In the illustrated embodiment, the signal contacts 28 include receptacle-type mating ends having a receptacle that is configured to receive a pin-type contact 30 of the header connector 14. Other types, structures, and/or the like of signal contacts 28 may be provided in other embodiments.

The mounting contacts 40 are configured to be mounted to the corresponding circuit board in electrical contact therewith to electrically connect the signal contacts 28 to the circuit board. When the contact module 26 is mounted to the housing 24 of the receptacle connector 12, the mounting contacts 40 extend along (and define a portion of) the mounting interface 20 of the receptacle connector 12 for mounting the receptacle connector 12 to the circuit board. In the illustrated embodiment, the mounting contacts 40 are compliant eye-of-the needle (EON) pins, but any other type, structure, and/or the like of contact may additionally or alternatively be used to mount the receptacle connector 12 to the circuit board, such as, but not limited to, a different type of compliant pin, a solder tail, a surface mount structure, and/or the like.

The contact modules 26 include ground shields 32 that provide impedance control along the signal path and/or electrical shielding for the signal contacts 28 from electromagnetic interference (EMI) and/or radio frequency interference (RFI). The ground shields 32 include ground contacts 34 that are configured to mate with corresponding mating ground shields 36 (shown in FIGS. 1 and 3-6) of the header connector 14. The contact modules 26 are mounted to the housing 24 such that the ground contacts 34 are received in corresponding ground contact openings. Optionally, a single ground contact 34 is received in each ground contact opening. The ground contact openings also receive the corresponding mating ground shields 36 of the header connector 14 therein when the receptacle connector 12 is mated with the header connector 14.

Each ground shield 32 includes a body 42 that extends a length from a front end 44 to a rear end 46. The body 42 also extends from a mounting end 48 to an opposite end 50. The body 42 of the ground shield 32 is electrically conductive and is configured to provide impedance control and/or shield the signal contacts 28 from electromagnetic interference (EMI) and/or radio frequency interference (RFI). Specifically, the body 42 extends over at least a portion of the corresponding conductor array of the contact module 26 when the body 42 is mounted to the corresponding carrier 38.

The ground shield 32 includes mounting contacts 52, which extend along the mounting end 48 and are configured to be mounted to the corresponding circuit board in electrical contact therewith to electrically connect the ground shield 32 to a ground plane (not shown) of the circuit board. When the contact module 26 that includes the ground shield 32 is mounted to the housing 24 of the receptacle connector 12, the mounting contacts 52 extend along (and define a portion of) the mounting interface 20 of the receptacle connector 12 for mounting the receptacle connector 12 to the circuit board. In the illustrated embodiment, the mounting contacts 52 are compliant eye-of-the needle (EON) pins. But, additionally or alternatively, any other type, structure, and/or the like of contact may be used to mount the receptacle connector 12 to the circuit board, such as, but not limited to, a different type of compliant pin, a solder tail, a surface mount structure, and/or the like.

The ground contacts 34 extend along the front end 44 of the body 42 of the ground shield 32. As should be apparent from FIG. 2 and the description herein, the ground contacts 34 are electrically connected together by the body 42 of the ground shield 32 in the illustrated embodiment. But, alternatively the ground contacts 34 are not electrically connected together. When the ground shield 32 is mounted to the corresponding carrier 38 of the corresponding contact module 26, the ground contacts 34 define a portion of the mating interface 16 of the receptacle connector 12. In the illustrated embodiment, the ground contacts 34 include spring beams. Other types, structures, and/or the like of the ground contacts 34 may be provided in other embodiments.

Figure 3:
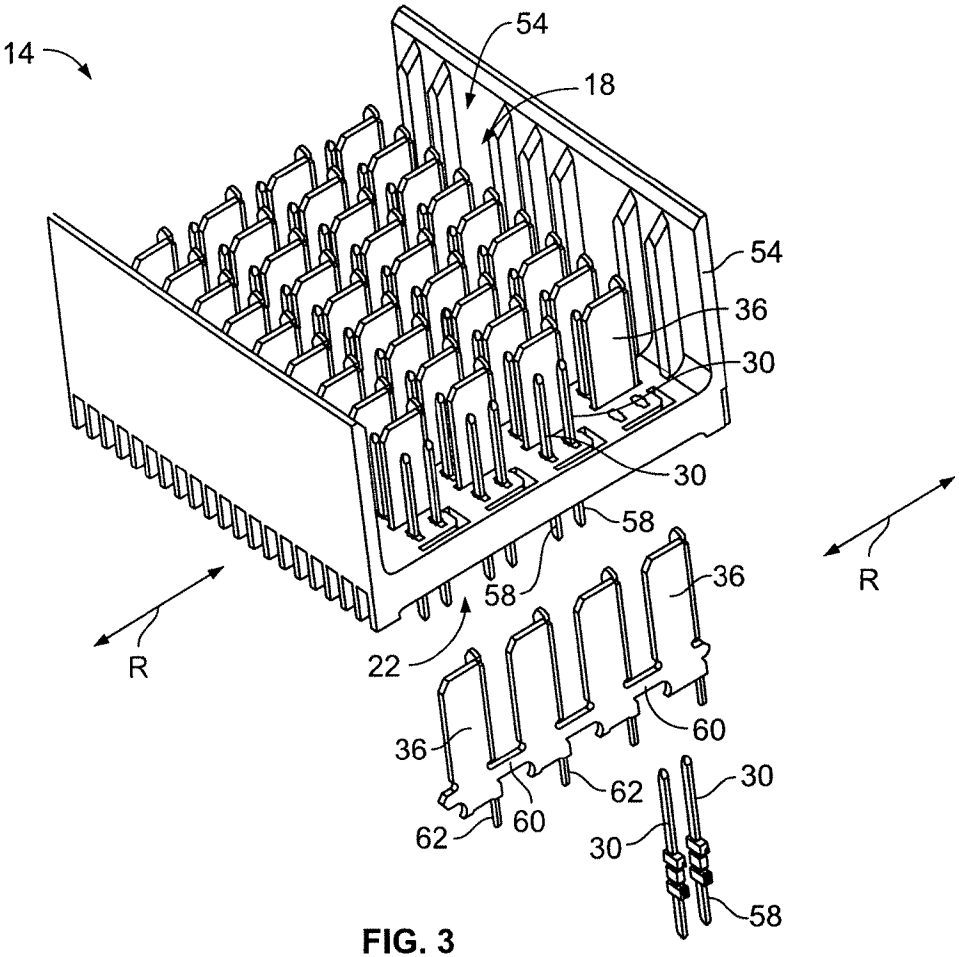
FIG. 3 is a partially exploded perspective view of an embodiment of a header connector of the electrical connector system shown in FIG. 1.

FIG. 3 is a partially exploded perspective view of an embodiment of the header connector 14. The header connector 14 includes a housing 54 that holds the signal contacts 30 and the ground shields 36 of the header connector 14. The housing 54 is manufactured from a dielectric material, such as, but not limited to, a plastic material and/or the like. In the illustrated embodiment, the housing 54 of the header connector 14 includes a receptacle 56 that receives a portion of the housing 24 (shown in FIG. 2) of the receptacle connector 12 (shown in FIGS. 1, 2, 4, and 5) therein when the connectors 12 and 14 are mated together.

As shown in FIG. 3, the signal contacts 30 extend along the mating interface 18 of the header connector 14 for mating with the corresponding mating signal contacts 28 (shown in FIGS. 2 and 5) of the receptacle connector 12. Optionally, the signal contacts 30 are arranged in pairs carrying differential signals, as is shown in the illustrated embodiment. The signal contacts 30 may be arranged in any pattern. In the illustrated embodiment, the signal contacts 30 are arranged in an array of rows and columns; however, other orientations are possible in other embodiments. In the illustrated embodiment, the signal contacts 30 include pins; however, other types, structures, and/or the like of signal contacts 30 may be provided in other embodiments.

The signal contacts 30 of the header connector 14 include signal mounting ends 58 that extend along (and define a portion of) the mounting interface 22 of the header connector 14 for mounting the header connector 14 to the corresponding circuit board. Specifically, the signal mounting ends 58 are configured to be mounted to the corresponding circuit board in electrical contact therewith to electrically connect the signal contacts 30 to the circuit board. In the illustrated embodiment, the signal mounting ends 58 are compliant eye-of-the needle (EON) pins, but any other type, structure, and/or the like of contact may additionally or alternatively be used to mount the header connector 14 to the circuit board, such as, but not limited to, a different type of compliant pin, a solder tail, a surface mount structure, and/or the like.

The ground shields 36 of the header connector 14 provide impedance control and/or electrical shielding for the signal contacts 30 from EMI and/or RFI. Specifically, the ground shields 36 extend around at least a portion of corresponding signal contacts 30 (corresponding differential pairs in the illustrated embodiment) of the header connector 14. The ground shields 36 extend along (and define a portion of) the mating interface 18 of the header connector 14 for mating with the corresponding ground contacts 34 (shown in FIGS. 2, 4, and 5) of the receptacle connector 12. In the illustrated embodiment, the ground shields 36 create a commoned (i.e., electrically connected) ground structure between the connectors 12 and 14. As should be apparent from FIG. 3 and the description herein, in the illustrated embodiment, the ground shields 36 are electrically connected together with at least some adjacent ground shields 36 by electrical bridges 60. In the illustrated embodiment, the ground shields 36 within the same row R are electrically connected together. But, alternatively the ground shields 36 are not electrically connected together. The ground shields 36 include blade structures in the illustrated embodiment; however, other types, structures, and/or the like of the ground shields 36 may be provided in other embodiments. The ground shields 36 may be referred to herein as "ground contacts" (e.g., the ground shields 36 may be referred to herein as "ground contacts" in the Claims of this application).

The ground shields 36 of the header connector 14 include ground mounting ends 62 that extend along (and define a portion of) the mounting interface 22 of the header connector 14 for mounting the header connector 14 to the corresponding circuit board. Specifically, the ground mounting ends 62 are configured to be mounted to the corresponding circuit board in electrical contact therewith to electrically connect the ground shields 36 to a ground plane (not shown) of the circuit board. In the illustrated embodiment, the ground mounting ends 62 are compliant eye-of-the needle (EON) pins, but any other type, structure, and/or the like of contact may additionally or alternatively be used to mount the header connector 14 to the circuit board, such as, but not limited to, a different type of compliant pin, a solder tail, a surface mount structure, and/or the like.

Figure 4:
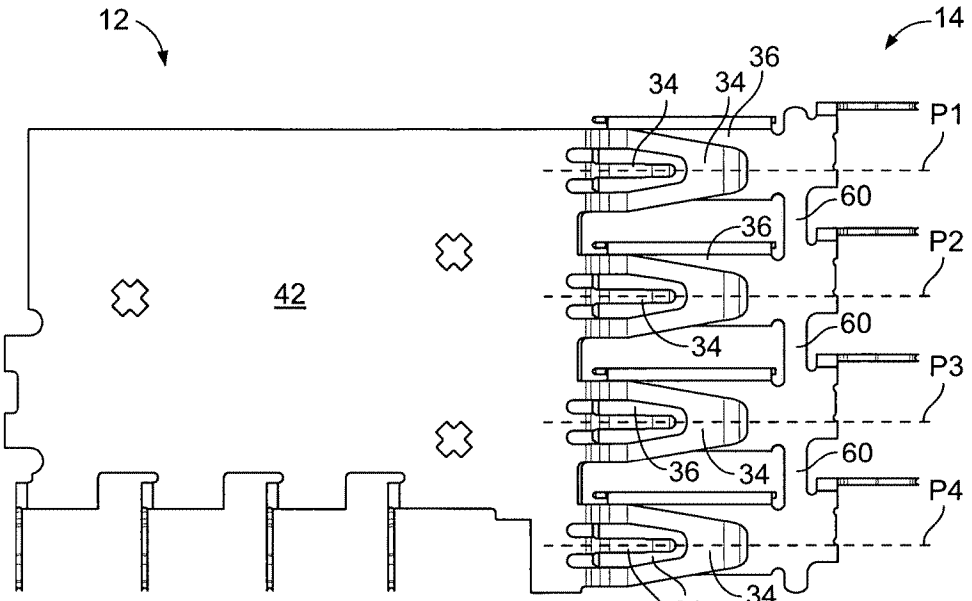
FIG. 4 is an elevational view of a portion of the receptacle connector shown in FIG. 2 and a portion of the header connector shown in FIG. 3 illustrating the connectors mated together.

FIG. 4 is an elevational view of a portion of the receptacle connector 12 and a portion of the header connector 14 illustrating the connectors 12 and 14 mated together. As shown in FIG. 4, the ground contacts 34 of the receptacle connector 12 are mated with the corresponding ground shields 36 of the header connector 14. As described above, in the illustrated embodiment, the ground contacts 34 of the receptacle connector 12 that are shown in FIG. 4 are electrically connected together by the body 42 of the ground shield 32 shown in FIG. 4. Moreover, in the illustrated embodiment, the ground shields 36 of the header connector 14 that are shown in FIG. 4 are electrically connected together by the electrical bridges 60 shown in FIG. 4. Accordingly, the mated ground contacts 34 and ground shields 36 shown in FIG. 4 define four parallel resistance paths $P_1$-$P_4$.

Referring again to FIGS. 2 and 3, the signal contacts 28 (not shown in FIG. 3) of the receptacle connector 12 (not shown in FIG. 3) and the signal contacts 30 (not shown in FIG. 2) of the header connector 14 (not shown in FIG. 2) are plated with one or more materials to improve the electrical performance and/or mechanical reliability of the signal contacts 28 and 30. For example, the signal contacts 28 and/or 30 may be plated with one or more materials that provide the signal contacts 28 and/or 30 with a lower contact resistance and/or with one or more materials that increase the durability of the signal contacts 28 and/or 30 to thereby reduce the wear generated from repeated mating and demating of the connectors 12 and 14. Providing the signal contacts 28 and/or 30 with a lower contact resistance may include, but is not limited to, plating the signal contacts 28 and 30 with a material with a relatively high electrical conductivity and relatively low electrical resistance, with a material that resists, inhibits, and/or reduces corrosion, and/or the like. Increasing the durability of the signal contacts 28 and/or 30 may include, but is not limited to, plating the signal contacts 28 and/or 30 with a material with a relatively high hardness, with a material that resists, inhibits, and/or reduces corrosion, and/or the like.

The signal contacts 28 and 30 may be fabricated from any base material, such as, but not limited to, copper, a copper alloy, and/or the like. The signal contacts 28 and 30 may include any number of layers of plating on the base material. Each layer of plating may have any thickness, which may be selected to provide the particular signal contact 28 or 30 with one or more electrical and/or mechanical properties (such as, but not limited to, durability, conductance, resistance, impedance, resilience, and/or the like). Examples of materials that may be plated on the signal contacts 28 and 30 include, but are not limited to, precious metals, precious metal alloys, nickel (Ni), nickel alloys, gold (Au), gold alloys, palladium (Pd), palladium alloys, palladium-nickel (PdNi), materials that inhibits, resists, and/or reduces corrosion, materials with a relatively high electrical conductivity and relatively low electrical resistance, materials with a relatively high hardness, and/or the like.

Examples of materials with which the signal contacts 28 and 30 may be plated to reduce the contact resistance of the signal contacts 28 and 30 include, but are not limited to, precious metals, precious metal alloys, gold (Au), gold alloys, palladium (Pd), palladium alloys, palladium-nickel (PdNi), materials that inhibits, resists, and/or reduces corrosion, materials with a relatively high electrical conductivity and relatively low electrical resistance, and/or the like.

Examples of materials with which the signal contacts 28 and 30 may be plated to increase the durability of the signal contacts 28 an 30 include, but are not limited to, precious metals, precious metal alloys, nickel (Ni), nickel alloys, gold (Au), gold alloys, palladium (Pd), palladium alloys, palladium-nickel (PdNi), materials that inhibits, resists, and/or reduces corrosion, materials with a relatively high hardness, and/or the like.

The ground contacts 34 (not shown in FIG. 3) of the receptacle connector 12 and the ground shields 36 (not shown in FIG. 2) of the header connector 14 may be plated with one or more materials, for example to improve the electrical performance and/or mechanical reliability of the ground contacts 34 and the ground shields 36. In some embodiments, the ground contacts 34 and/or the ground shields 36 are not plated with any materials (i.e., no plating is deposited on the base material of the ground contacts 34 and/or the ground shields 36), as will be briefly discussed below.

The ground contacts 34 and the ground shields 36 have different plating as compared to the signal contacts 28 and 30. Specifically, the plating of the signal contacts 28 and 30 may include at least one material that is different from any of the plating materials of the ground contacts 34 and the ground shields 36. In other words, in some embodiments, the plating of the ground contacts 34 and the ground shields 36 lacks one or more of the materials contained within the plating of the signal contacts 28 and 30. In addition or alternative to lacking one or more materials of the signal contact plating, the plating of the ground contacts 34 and the ground shields 36 may be different by including less of one or more materials contained within the plating of the signal contacts 28 and 30. For example, the plating of the ground contacts 34 and the ground shields 36 may include a layer of material that is thinner than the corresponding layer of material of the signal contact plating, and/or the ground contact plating may include fewer layers of a particular material as compared to the signal contact plating.

The ground contacts 34 and the ground shields 36 may have any number of layers of plating on the base material thereof, which may be greater than, equal to, or less than the number of layers of the plating of the signal contacts 28 and 30. In some embodiments, the ground contacts 34 and the ground shields 36 are not plated such that the ground contacts 34 and the ground shields 36 have zero layers of plating on the base material thereof.

In the embodiments described and illustrated herein, the plating of the ground contacts 34 and the ground shields 36 is different from the plating of the signal contacts 28 and 30 by lacking (and/or including a lesser amount of) one or more materials that are selected to provide the signal contacts 28 and 30 with a lower contact resistance (such as, but not limited to, a material that reduces rust, corrosion, oxidation, another chemical process, and/or the like). In other words, the at least one plating material of the signal contacts 28 and 30 that is different from the plating materials of the ground contacts 34 and the ground shields 36 is a material that provides a reduced contact resistance. Accordingly, the ground contacts 34 and the ground shields 36 have a higher contact resistance as compared to the signal contacts 28 and 30, for example because of rust, corrosion, oxidation, another chemical process, and/or the like resulting from exposure of the ground contacts 34 and/or the ground shields 36 to the environment. For example, the signal contacts 28 and 30 may have a contact resistance of equal to or less than 10 milliohms, while the ground contacts 34 and the ground shields 36 may have a contact resistance from approximately 20 milliohms to approximately 1 ohm.

The higher contact resistance of the ground contacts 34 and the ground shields 36 may not adversely affect the electrical performance of the connectors 12 and 14 at relatively high frequencies (e.g., at frequencies of at least 10 Gigabits). At relatively high frequencies, the magnitude of electrical resistance depends on, for example, interface dimensions, plating materials, dielectric materials, surface roughness, skin effect, and/or the like. It should be understood that the impedance of an electrical interface at relatively high frequency is determined not only by direct current (DC) contact resistance, but also by capacitive and inductive coupling mechanisms. For example, because of the parallel resistance paths $P_1$-$P_4$ (described above) defined by the ground contacts 34 and the ground shields 36, the ground contact resistance will be reduced according to the parallel resistor equation. Specifically, the parallel ground resistance circuit of the parallel resistance paths $P_1$-$P_4$ will lower the effect of any single relatively high resistance value at individual ground interfaces (i.e., an individual interface of a ground contact 34 and the corresponding ground shield 36; e.g., the ground interface 100 described below with reference to FIG. 5).

Figure 5:
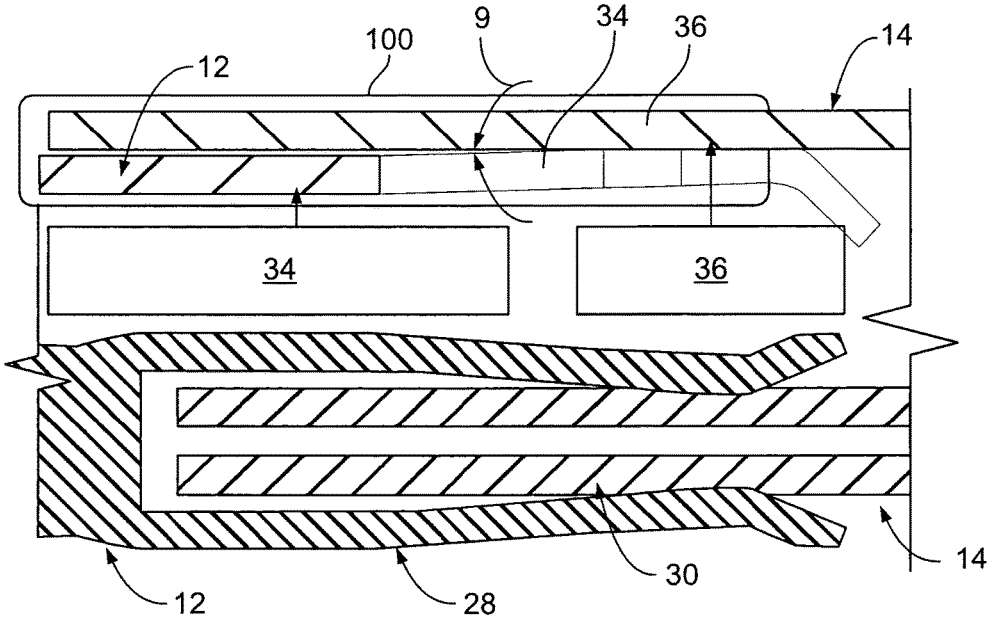
FIG. 5 is a cross-sectional view also illustrating the receptacle and header connectors mated together.

Additionally, and for example, FIG. 5 is a cross-sectional view of a portion of the receptacle connector 12 and a portion of the header connector 14 illustrating the connectors 12 and 14 mated together. Specifically, FIG. 5 illustrates a ground contact 34 of the receptacle connector 12 mated with the corresponding ground shield 36 of the header connector 14 at a ground interface 100. As can be seen in FIG. 5, the ground contacts 34 and the ground shields 36 mate together at the ground interface 100 with a relatively shallow (e.g., less than approximately 5°) angle of attack a, which may increase the capacitive coupling mechanism between the ground contacts 34 and the ground shields 36. Specifically, the relatively shallow angle of attack a between the ground contacts 34 and the ground shields 36 may create a higher capacitance value and therefore a lower resistance value. Moreover, a relatively shallow angle of attack a combined with a plurality of the ground contacts 34 and/or ground shields 36 arranged in parallel resistance paths may further lower the contact resistance of the ground interfaces 100.

As described above, the higher contact resistance of the ground contacts 34 and the ground shields 36 may not adversely affect the electrical performance of the connectors 12 and 14 at relatively high frequencies. Specifically, the higher contact resistance of the ground contacts 34 and the ground shields 36 as compared to the signal contacts 28 and 30 may not lower the transmission speed of the connectors 12 and 14. For example, the higher contact resistance of the ground contacts 34 and the ground shields 36 may not inhibit the ability of the connectors 12 and 14 to reliably transmit signals at a rate of at least 10 Gigabits.

Eliminating or reducing plating materials that are selected to provide a lower contact resistance may reduce the cost of plating the ground contacts 34 and the ground shields 36, which may thereby reduce the cost of manufacturing the connectors 12 and 14. For example, plating materials that provide lower contact resistance often include precious metals, which are relatively expensive. Eliminating or reducing the amount of one or more precious metals of the plating of the ground contacts 34 and the ground shields 36 may significantly reduce the cost of such plating. Moreover, embodiments that reduce the number of layers of the ground contact plating may lower the cost of the plating process used to plate the ground contacts 34 and the ground shields 36.

The ground contacts 34 and the ground shields 36 may be fabricated from any base material, such as, but not limited to, copper, a copper alloy, stainless steel, silver-nickel (AgNi), and/or the like. Each layer of plating of the ground contacts 34 and the ground shields 36 may have any thickness, which may be selected to provide the particular ground contact 34 or ground shield 36 with one or more electrical and/or mechanical properties (such as, but not limited to, durability, conductance, resistance, impedance, resilience, and/or the like).

Examples of materials that may be plated on the ground contacts 34 and the ground shield 36 include, but are not limited to, precious metals, precious metal alloys, gold, gold alloys, palladium, palladium alloys, dilute palladium-nickel, nickel alloys, nickel-phosphorus (NiP), nickel-tungsten (NiW), structured nickel, cobalt-phosphorus (CoP), chromium (Cr), copper (Cu), zinc (Zn), zinc-nickel (ZnNi), zinc with steel, carbon, a carbon ink, a carbon epoxy, and/or the like.

Figure 6:
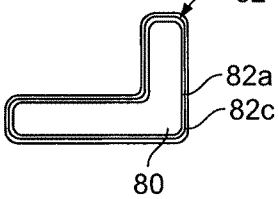
FIG. 6 is a cross-sectional view of an embodiment of a signal contact and a ground shield of the header connector shown in FIG. 3.
Figure 6:
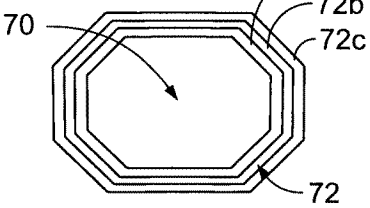

FIG. 6 illustrates an embodiment of the different plating of the ground contacts 34 (shown in FIGS. 2, 4, and 5) and the ground shields 36 as compared to the signal contacts 28 (shown in FIGS. 2 and 5) and the signal contacts 30. Specifically, FIG. 6 is a cross-sectional view illustrating one non-limiting example of different plating of a ground shield 36 and a signal contact 30.

The signal contact 30 includes a base material 70 and three layers of plating 72 on the base material 70. Specifically, the plating 72 of the signal contact 30 includes a base layer 72*a* of nickel, an intermediate layer 72*b* of palladium-nickel, and an outer layer 72*c* of gold. The palladium-nickel intermediate layer 72*b* facilitates reducing the contact resistance of the signal contact 30.

The ground shield 36 includes a base material 80 and two layers of plating 82 on the base material 80. Specifically, the plating 82 of the ground shield 36 includes a base layer 82*a* of nickel and an outer layer 82*c* of gold. The ground shield plating 82 does not include the palladium-nickel intermediate layer 72*b* of the signal contact plating 72. Accordingly, the ground shield 36 has a higher contact resistance as compared to the signal contact 30 but uses less plating material (e.g., less of the relatively-expensive precious metal palladium) and is therefore less expensive to plate.

Other non-limiting examples of embodiments of the plating configuration for the ground contacts 34 and the ground shield 36 include, but are not limited to: base material with a layer of nickel-phosphorus plating, base material with a layer of nickel-tungsten plating, base material with a layer of structured nickel plating, base material with a layer of pure nickel plating, base material with a layer of cobalt-phosphorus plating, base material with a layer of dilute palladium-nickel, base material with a layer of chromium (non-hex) plating, a base material of stainless steel with no plating, a base material of silver-nickel with no plating, plating that includes a passivated layer of copper or a copper alloy, base material with a layer of zinc-nickel plating, an exposed base material with a sacrificial area of plating material (such as, but not limited to, zinc with steel), base material with a carbon based layer of plating, base material with a layer of carbon ink or epoxy, and/or the like.

Although described and illustrated herein with respect to the connectors 12 and 14, the embodiments described and/or illustrated herein are not limited to such electrical connectors, but rather may be used with any other type of electrical connector, such as, but not limited to, cable connectors, other types of circuit board connectors, and/or the like.

The embodiments described and/or illustrated herein may reduce the cost of plating ground contacts without sacrificing electrical performance of an electrical connector that includes the ground contacts. The embodiments described and/or illustrated herein may provide an electrical connector that is less expensive to manufacture for a given electrical performance.

As used herein, a "ground contact" may include any structure, type, and/or the like of ground conductor, such as, but not limited to, a ground shield for a contact module (e.g., the ground shields 32 shown in FIGS. 2 and 4), a spring beam (e.g., the ground contacts 34 shown in FIGS. 2, 4, and 5), a blade structure (e.g., the ground shields 36 shown in FIGS. 1 and 3-6), a pin structure (e.g., the pin structure of the signal contacts 30 shown in FIGS. 1, 3, 5, and 6), a compliant pin structure (e.g., a compliant EON pin such as, but not limited to, the pins 40, 52, 58, and/or 62 described and illustrated herein), a solder tail structure, a surface mount structure, and/or the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing;

contact modules held by the housing, the contact modules including ground shields having ground contacts, the contact modules having a dielectric carrier that holds signal contacts;

the ground contacts being configured for mating with corresponding ground contacts of a complementary mating connector, wherein the ground contacts are plated with a ground contact plating that includes at least one ground contact plating material wherein an interface between the ground contacts held and the corresponding ground contacts of the complementary mating connector has a contact resistance from approximately 20 milliohms to approximately 1 ohm; and the signal contacts being configured for mating with corresponding signal contacts of the mating connector, the signal contacts being plated with a signal contact plating, wherein the signal contact plating includes at least one material that is different from the at least one ground contact plating material, wherein an interface between the signal contacts held and the signal contacts of the complimentary mating connector has a contact resistance from approximately equal to or less than 10 milliohms.

2. The electrical connector of claim 1, wherein the ground contacts have a contact resistance that is greater than a contact resistance of the signal contacts.

3. The electrical connector of claim 1, wherein the signal contact plating of the signal contacts comprises a greater number of layers as compared to the ground contact plating of the ground contacts.

4. The electrical connector of claim 1, wherein the at least one ground contact plating material of the ground contact plating comprises at least one of a precious metal, nickel (Ni), gold (Au), nickel-phosphorus (NiP), nickel-tungsten (NiW), structured nickel, cobalt-phosphorus (CoP), palladium (Pd), dilute palladium-nickel (PdNi), chromium (Cr), copper (Cu), zinc (Zn), zinc-nickel (ZnNi), zinc with steel, carbon, a carbon ink, or a carbon epoxy.

5. The electrical connector of claim 1, wherein the at least one material that is different comprises at least one of palladium-nickel (PdNi) or gold (Au).

6. The electrical connector of claim 1, wherein the signal contact plating and the ground contact plating each comprise a nickel base layer and a gold outer layer, and wherein the at least one material that is different comprises a palladium-nickel intermediate layer.

7. The electrical connector of claim 1, wherein the ground contact plating contains a lesser amount of precious metal as compared to the signal contact plating.

8. The electrical connector of claim 1, wherein the ground contact plating does not include a precious metal.

9. The electrical connector of claim 1, wherein the ground contacts define parallel resistance paths with respect to each other.

10. The electrical connector of claim 1, wherein the ground contacts mate with the corresponding ground contacts of the complementary mating connector at an angle of attack that is less than approximately 5°.

11. The electrical connector of claim 1, wherein the ground contacts are electrically connected together.

12. The electrical connector of claim 1, wherein the ground contacts are fabricated from a different base material as compared to the signal contacts.

13. The electrical connector of claim 1, wherein the ground shields extend along a length of the dielectric carrier.

14. An electrical connector comprising:

a housing;

contact modules held by the housing, the contact modules including ground shields having ground contacts, the contact modules having a dielectric carrier that holds signal contacts;

the ground contacts being configured for mating with corresponding ground contacts of a complementary mating connector, the ground contacts defining parallel resistance paths with respect to each other, wherein the ground contacts mate with corresponding ground contacts of the complementary mating connector at a ground interface an angle of attack that is less than approximately 5°; and the signal contacts being configured for mating with corresponding signal contacts of the mating connector, wherein the signal contacts are plated with a greater number of layers of plating as compared to the ground contacts.

15. The electrical connector of claim 14, wherein the ground contacts are not plated with any layers of plating such that the ground contacts include zero plating layers.

16. The electrical connector of claim 14, wherein the ground contacts are plated with a single layer of plating.

17. The electrical connector of claim 14, wherein the signal contacts and the ground contacts each comprise a nickel base layer and a gold outer layer of plating, and wherein the signal contacts comprises a palladium-nickel intermediate layer of plating.

18. The electrical connector of claim 14, wherein the ground contacts are fabricated from a different base material as compared to the signal contacts.

19. The electrical connector of claim 14, wherein the ground contacts have a contact resistance that is greater than a contact resistance of the signal contacts.

20. The electrical connector of claim 14, wherein the ground contacts contain a lesser amount of precious metal as compared to the signal contacts.

* * * * *